US009231305B2

(12) United States Patent
Kato

(10) Patent No.: US 9,231,305 B2
(45) Date of Patent: Jan. 5, 2016

(54) WIRELESS IC DEVICE

(75) Inventor: Noboru Kato, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 313 days.

(21) Appl. No.: 13/080,781

(22) Filed: Apr. 6, 2011

(65) Prior Publication Data

US 2011/0181486 A1 Jul. 28, 2011

Related U.S. Application Data

(63) Continuation of application No. PCT/JP2009/067140, filed on Oct. 1, 2009.

(30) Foreign Application Priority Data

Oct. 24, 2008 (JP) ..... 2008-274771

(51) Int. Cl.
*H01Q 1/50* (2006.01)
*H01Q 7/06* (2006.01)
*H01Q 1/22* (2006.01)

(52) U.S. Cl.
CPC ..... *H01Q 7/06* (2013.01); *H01Q 1/2225* (2013.01)

(58) Field of Classification Search
None
See application file for complete search history.

(56) References Cited

U.S. PATENT DOCUMENTS 3,364,564 A 1/1968 Kurtz et al.
4,794,397 A 12/1988 Ohe et al.
5,232,765 A 8/1993 Yano et al.
5,253,969 A 10/1993 Richert
5,337,063 A 8/1994 Takahira
5,374,937 A 12/1994 Tsunekawa et al.
5,399,060 A 3/1995 Richert
5,491,483 A 2/1996 D'Hont
5,528,222 A 6/1996 Moskowitz et al.
5,757,074 A 5/1998 Matloubian et al.

(Continued)

FOREIGN PATENT DOCUMENTS

DE 10 2006 057 369 A1 6/2008
EP 0 694 874 A2 1/1996

(Continued)

OTHER PUBLICATIONS

Official Communication issued in International Application No. PCT/JP2007/066007, mailed on Nov. 27, 2007.

(Continued)

*Primary Examiner* — Sujoy Kundu
*Assistant Examiner* — Steven J Malone
(74) *Attorney, Agent, or Firm* — Keating & Bennett, LLP

(57) ABSTRACT

A wireless IC device has a resonant frequency that is hardly altered or affected by external influences and reliably communicates with a reader/writer. The wireless IC device includes a wireless IC chip arranged to process a radio signal, a feeder circuit board coupled to the wireless IC chip and including a feeder circuit, and a radiation electrode arranged at least one principal surface of the feeder circuit board. The feeder circuit board includes a magnetic material and has the feeder circuit disposed therein. The radiation electrode is disposed on at least one principal surface of the feeder circuit board so as to be electromagnetically coupled to the feeder circuit and includes at least two open ends. The wireless IC chip is coupled to the radiation electrode through the feeder circuit and communicates with a reader/writer using HF band frequency.

10 Claims, 5 Drawing Sheets

(56) References Cited

U.S. PATENT DOCUMENTS

| | | | |
|---|---|---|---|
| 5,854,480 | A | 12/1998 | Noto |
| 5,903,239 | A | 5/1999 | Takahashi et al. |
| 5,936,150 | A | 8/1999 | Kobrin et al. |
| 5,955,723 | A | 9/1999 | Reiner |
| 5,995,006 | A | 11/1999 | Walsh |
| 6,104,311 | A | 8/2000 | Lastinger |
| 6,107,920 | A | 8/2000 | Eberhardt et al. |
| 6,172,608 | B1 | 1/2001 | Cole |
| 6,181,287 | B1 | 1/2001 | Beigel |
| 6,190,942 | B1 | 2/2001 | Wilm et al. |
| 6,249,258 | B1 | 6/2001 | Bloch et al. |
| 6,259,369 | B1 | 7/2001 | Monico |
| 6,271,803 | B1 | 8/2001 | Watanabe et al. |
| 6,335,686 | B1 | 1/2002 | Goff et al. |
| 6,362,784 | B1 | 3/2002 | Kane et al. |
| 6,367,143 | B1 | 4/2002 | Sugimura |
| 6,378,774 | B1 | 4/2002 | Emori et al. |
| 6,406,990 | B1 | 6/2002 | Kawai |
| 6,448,874 | B1 | 9/2002 | Shiino et al. |
| 6,462,716 | B1 | 10/2002 | Kushihi |
| 6,542,050 | B1 | 4/2003 | Arai et al. |
| 6,600,459 | B2 | 7/2003 | Yokoshima et al. |
| 6,634,564 | B2 | 10/2003 | Kuramochi |
| 6,664,645 | B2 | 12/2003 | Kawai |
| 6,763,254 | B2 | 7/2004 | Nishikawa |
| 6,812,707 | B2 | 11/2004 | Yonezawa et al. |
| 6,828,881 | B2 | 12/2004 | Mizutani et al. |
| 6,837,438 | B1 | 1/2005 | Takasugi et al. |
| 6,861,731 | B2 | 3/2005 | Buijsman et al. |
| 6,927,738 | B2 | 8/2005 | Senba et al. |
| 6,963,729 | B2 | 11/2005 | Uozumi |
| 7,088,249 | B2 | 8/2006 | Senba et al. |
| 7,088,307 | B2 | 8/2006 | Imaizumi |
| 7,112,952 | B2 | 9/2006 | Arai et al. |
| 7,119,693 | B1 | 10/2006 | Devilbiss |
| 7,129,834 | B2 | 10/2006 | Naruse et al. |
| 7,248,221 | B2 | 7/2007 | Kai et al. |
| 7,250,910 | B2 | 7/2007 | Yoshikawa et al. |
| 7,276,929 | B2 | 10/2007 | Arai et al. |
| 7,317,396 | B2 | 1/2008 | Ujino |
| 7,405,664 | B2 | 7/2008 | Sakama et al. |
| 2002/0011967 | A1 | 1/2002 | Goff et al. |
| 2002/0015002 | A1 | 2/2002 | Yasukawa et al. |
| 2002/0044092 | A1 | 4/2002 | Kushihi |
| 2002/0067316 | A1 | 6/2002 | Yokoshima et al. |
| 2002/0093457 | A1 | 7/2002 | Hamada et al. |
| 2003/0006901 | A1 | 1/2003 | Kim et al. |
| 2003/0020661 | A1 | 1/2003 | Sato |
| 2003/0045324 | A1 | 3/2003 | Nagumo et al. |
| 2003/0169153 | A1 | 9/2003 | Muller |
| 2004/0001027 | A1 | 1/2004 | Killen et al. |
| 2004/0026519 | A1 | 2/2004 | Usami et al. |
| 2004/0056823 | A1 | 3/2004 | Zuk et al. |
| 2004/0066617 | A1 | 4/2004 | Hirabayashi et al. |
| 2004/0217915 | A1 | 11/2004 | Imaizumi |
| 2004/0219956 | A1 | 11/2004 | Iwai et al. |
| 2004/0227673 | A1 | 11/2004 | Iwai et al. |
| 2004/0252064 | A1 | 12/2004 | Yuanzhu |
| 2005/0092836 | A1 | 5/2005 | Kudo |
| 2005/0099337 | A1 | 5/2005 | Takei et al. |
| 2005/0125093 | A1 | 6/2005 | Kikuchi et al. |
| 2005/0134460 | A1 | 6/2005 | Usami |
| 2005/0134506 | A1 | 6/2005 | Egbert |
| 2005/0138798 | A1 | 6/2005 | Sakama et al. |
| 2005/0140512 | A1 | 6/2005 | Sakama et al. |
| 2005/0232412 | A1 | 10/2005 | Ichihara et al. |
| 2005/0236623 | A1 | 10/2005 | Takechi et al. |
| 2005/0275539 | A1 | 12/2005 | Sakama et al. |
| 2006/0001138 | A1 | 1/2006 | Sakama et al. |
| 2006/0044192 | A1 | 3/2006 | Egbert |
| 2006/0055601 | A1 | 3/2006 | Kameda et al. |
| 2006/0071084 | A1 | 4/2006 | Detig et al. |
| 2006/0109185 | A1 | 5/2006 | Iwai et al. |
| 2006/0145872 | A1 | 7/2006 | Tanaka et al. |
| 2006/0158380 | A1 | 7/2006 | Son et al. |
| 2006/0170606 | A1 | 8/2006 | Yamagajo et al. |
| 2006/0214801 | A1 | 9/2006 | Murofushi et al. |
| 2006/0220871 | A1 | 10/2006 | Baba et al. |
| 2006/0243811 | A1* | 11/2006 | Koyama et al. ..... 235/492 |
| 2006/0244676 | A1 | 11/2006 | Uesaka |
| 2006/0267138 | A1 | 11/2006 | Kobayashi |
| 2007/0004028 | A1 | 1/2007 | Lair et al. |
| 2007/0018893 | A1 | 1/2007 | Kai et al. |
| 2007/0040028 | A1 | 2/2007 | Kawamata |
| 2007/0052613 | A1 | 3/2007 | Gallschuetz et al. |
| 2007/0057854 | A1 | 3/2007 | Oodachi et al. |
| 2007/0069037 | A1 | 3/2007 | Kawai |
| 2007/0132591 | A1 | 6/2007 | Khatri |
| 2007/0164414 | A1* | 7/2007 | Dokai et al. ..... 257/679 |
| 2007/0200782 | A1 | 8/2007 | Hayama et al. |
| 2007/0252700 | A1 | 11/2007 | Ishihara et al. |
| 2007/0252703 | A1 | 11/2007 | Kato et al. |
| 2007/0285335 | A1 | 12/2007 | Bungo et al. |
| 2007/0290928 | A1 | 12/2007 | Chang et al. |
| 2008/0024156 | A1 | 1/2008 | Arai et al. |
| 2008/0087990 | A1 | 4/2008 | Kato et al. |
| 2008/0169905 | A1 | 7/2008 | Slatter |
| 2008/0272885 | A1 | 11/2008 | Atherton |
| 2009/0002130 | A1 | 1/2009 | Kato |
| 2009/0009007 | A1 | 1/2009 | Kato et al. |
| 2009/0065594 | A1 | 3/2009 | Kato et al. |
| 2009/0109102 | A1 | 4/2009 | Dokai et al. |
| 2009/0160719 | A1 | 6/2009 | Kato et al. |
| 2009/0201116 | A1 | 8/2009 | Orihara |
| 2009/0231106 | A1 | 9/2009 | Okamura |
| 2009/0262041 | A1 | 10/2009 | Ikemoto et al. |

FOREIGN PATENT DOCUMENTS

| | | | |
|---|---|---|---|
| EP | 0 977 145 | A2 | 2/2000 |
| EP | 1 010 543 | A1 | 6/2000 |
| EP | 1 160 915 | A2 | 12/2001 |
| EP | 1 170 795 | A2 | 1/2002 |
| EP | 1 227 540 | A1 | 7/2002 |
| EP | 1 280 232 | A1 | 1/2003 |
| EP | 1 280 350 | A1 | 1/2003 |
| EP | 1 343 223 | A1 | 9/2003 |
| EP | 1 357 511 | A2 | 10/2003 |
| EP | 1 548 872 | A1 | 6/2005 |
| EP | 1 703 589 | A1 | 9/2006 |
| EP | 1 744 398 | A1 | 1/2007 |
| EP | 1 841 005 | A1 | 10/2007 |
| EP | 1 865 574 | A1 | 12/2007 |
| EP | 1 976 056 | A1 | 10/2008 |
| EP | 1 993 170 | A1 | 11/2008 |
| EP | 2 009 738 | A1 | 12/2008 |
| EP | 2 012 258 | A1 | 1/2009 |
| EP | 2 251 934 | A1 | 2/2009 |
| EP | 2 148 449 | A1 | 1/2010 |
| GB | 2 305 075 | A | 3/1997 |
| JP | 50-143451 | A | 11/1975 |
| JP | 62-127140 | U | 8/1987 |
| JP | 02-164105 | A | 6/1990 |
| JP | 03-262313 | A | 11/1991 |
| JP | 04-150011 | A | 5/1992 |
| JP | 04-167500 | A | 6/1992 |
| JP | 05-327331 | A | 12/1993 |
| JP | 6-53733 | A | 2/1994 |
| JP | 06-077729 | A | 3/1994 |
| JP | 06-177635 | A | 6/1994 |
| JP | 6-260949 | A | 9/1994 |
| JP | 07-183836 | A | 7/1995 |
| JP | 08-056113 | A | 2/1996 |
| JP | 8-87580 | A | 4/1996 |
| JP | 08-088586 | A | 4/1996 |
| JP | 11-149537 | A | 6/1996 |
| JP | 08-176421 | A | 7/1996 |
| JP | 08-180160 | A | 7/1996 |
| JP | 08-279027 | A | 10/1996 |
| JP | 08-307126 | A | 11/1996 |
| JP | 08-330372 | A | 12/1996 |
| JP | 09-014150 | A | 1/1997 |
| JP | 09-035025 | A | 2/1997 |
| JP | 9-93029 | A | 4/1997 |

(56) References Cited

FOREIGN PATENT DOCUMENTS

| | | | |
|---|---|---|---|
| JP | 09-245381 | A | 9/1997 |
| JP | 09-252217 | A | 9/1997 |
| JP | 09-270623 | A | 10/1997 |
| JP | 9-512367 | A | 12/1997 |
| JP | 10-69533 | A | 3/1998 |
| JP | 10-069533 | A | 3/1998 |
| JP | 10-505466 | A | 5/1998 |
| JP | 10-171954 | A | 6/1998 |
| JP | 10-193849 | A | 7/1998 |
| JP | 10-193851 | A | 7/1998 |
| JP | 10-293828 | A | 11/1998 |
| JP | 11-039441 | A | 2/1999 |
| JP | 11-075329 | A | 3/1999 |
| JP | 11-085937 | A | 3/1999 |
| JP | 11-88241 | A | 3/1999 |
| JP | 11-102424 | A | 4/1999 |
| JP | 11-103209 | A | 4/1999 |
| JP | 11-149536 | A | 6/1999 |
| JP | 11-149538 | A | 6/1999 |
| JP | 11-219420 | A | 8/1999 |
| JP | 11-220319 | A | 8/1999 |
| JP | 11-328352 | A | 11/1999 |
| JP | 11-346114 | A | 12/1999 |
| JP | 11-515094 | A | 12/1999 |
| JP | 2000-21128 | A | 1/2000 |
| JP | 2000-021639 | A | 1/2000 |
| JP | 2000-022421 | A | 1/2000 |
| JP | 2005-229474 | A | 1/2000 |
| JP | 2000-059260 | A | 2/2000 |
| JP | 2000-085283 | A | 3/2000 |
| JP | 2000-090207 | A | 3/2000 |
| JP | 2000-132643 | A | 5/2000 |
| JP | 2000-137778 | A | 5/2000 |
| JP | 2000-137779 | A | 5/2000 |
| JP | 2000-137785 | A | 5/2000 |
| JP | 2000-148948 | A | 5/2000 |
| JP | 2000-172812 | A | 6/2000 |
| JP | 2000-209013 | A | 7/2000 |
| JP | 2000-222540 | A | 8/2000 |
| JP | 2000-510271 | A | 8/2000 |
| JP | 2000-242754 | A | 9/2000 |
| JP | 2000-243797 | A | 9/2000 |
| JP | 2000-251049 | A | 9/2000 |
| JP | 2000-261230 | A | 9/2000 |
| JP | 2000-276569 | A | 10/2000 |
| JP | 2000-286634 | A | 10/2000 |
| JP | 2000-286760 | A | 10/2000 |
| JP | 2000-311226 | A | 11/2000 |
| JP | 2000-321984 | A | 11/2000 |
| JP | 3075400 | U | 11/2000 |
| JP | 2000-349680 | A | 12/2000 |
| JP | 2001-10264 | A | 1/2001 |
| JP | 2001-028036 | A | 1/2001 |
| JP | 2007-18067 | A | 1/2001 |
| JP | 2001-043340 | A | 2/2001 |
| JP | 2001-66990 | A | 3/2001 |
| JP | 2001-76111 | A | 3/2001 |
| JP | 2001-505682 | A | 4/2001 |
| JP | 2001-168628 | A | 6/2001 |
| JP | 2001-188890 | A | 7/2001 |
| JP | 2001-240046 | A | 9/2001 |
| JP | 2001-256457 | A | 9/2001 |
| JP | 2001-257292 | A | 9/2001 |
| JP | 2001-514777 | A | 9/2001 |
| JP | 2001-319380 | A | 11/2001 |
| JP | 2001-331976 | A | 11/2001 |
| JP | 2001-332923 | A | 11/2001 |
| JP | 2001-339226 | A | 12/2001 |
| JP | 2001-344574 | A | 12/2001 |
| JP | 2001-351084 | A | 12/2001 |
| JP | 2001-352176 | A | 12/2001 |
| JP | 2002-024776 | A | 1/2002 |
| JP | 2002-026513 | A | 1/2002 |
| JP | 2002-32731 | A | 1/2002 |
| JP | 2002-042076 | A | 2/2002 |
| JP | 2002-063557 | A | 2/2002 |
| JP | 2002-505645 | A | 2/2002 |
| JP | 2002-76750 | A | 3/2002 |
| JP | 2002-076750 | A | 3/2002 |
| JP | 2002-150245 | A | 5/2002 |
| JP | 2002-157564 | A | 5/2002 |
| JP | 2002-158529 | A | 5/2002 |
| JP | 2002-175508 | A | 6/2002 |
| JP | 2002-183690 | A | 6/2002 |
| JP | 2002-185358 | A | 6/2002 |
| JP | 2002-204117 | A | 7/2002 |
| JP | 2002-522849 | A | 7/2002 |
| JP | 2002-230128 | A | 8/2002 |
| JP | 2002-232221 | A | 8/2002 |
| JP | 2002-252117 | A | 9/2002 |
| JP | 2002-259934 | A | 9/2002 |
| JP | 2002-280821 | A | 9/2002 |
| JP | 2002-298109 | A | 10/2002 |
| JP | 2002-308437 | A | 10/2002 |
| JP | 2002-319008 | A | 10/2002 |
| JP | 2002-319009 | A | 10/2002 |
| JP | 2002-319812 | A | 10/2002 |
| JP | 2002-362613 | A | 12/2002 |
| JP | 2002-373029 | A | 12/2002 |
| JP | 2002-373323 | A | 12/2002 |
| JP | 2002-374139 | A | 12/2002 |
| JP | 2003-006599 | A | 1/2003 |
| JP | 2003-016412 | A | 1/2003 |
| JP | 2003-026177 | A | 1/2003 |
| JP | 2003-030612 | A | 1/2003 |
| JP | 2003-44789 | A | 2/2003 |
| JP | 2003-046318 | A | 2/2003 |
| JP | 2003-58840 | A | 2/2003 |
| JP | 2003-067711 | A | 3/2003 |
| JP | 2003-069335 | A | 3/2003 |
| JP | 2003-076947 | A | 3/2003 |
| JP | 2003-76963 | A | 3/2003 |
| JP | 2003-78333 | A | 3/2003 |
| JP | 2003-078336 | A | 3/2003 |
| JP | 2003-085501 | A | 3/2003 |
| JP | 2003-085520 | A | 3/2003 |
| JP | 2003-87008 | A | 3/2003 |
| JP | 2003-87044 | A | 3/2003 |
| JP | 2003-099720 | A | 4/2003 |
| JP | 2003-099721 | A | 4/2003 |
| JP | 2003-110344 | A | 4/2003 |
| JP | 2003-132330 | A | 5/2003 |
| JP | 2003-134007 | A | 5/2003 |
| JP | 2003-155062 | A | 5/2003 |
| JP | 2003-158414 | A | 5/2003 |
| JP | 2003-168760 | A | 6/2003 |
| JP | 2003-179565 | A | 6/2003 |
| JP | 2003-187207 | A | 7/2003 |
| JP | 2003-187211 | A | 7/2003 |
| JP | 2003-188338 | A | 7/2003 |
| JP | 2003-188620 | A | 7/2003 |
| JP | 2003-198230 | A | 7/2003 |
| JP | 2003-209421 | A | 7/2003 |
| JP | 2003-216919 | A | 7/2003 |
| JP | 2003-218624 | A | 7/2003 |
| JP | 2003-233780 | A | 8/2003 |
| JP | 2003-242471 | A | 8/2003 |
| JP | 2003-243918 | A | 8/2003 |
| JP | 2003-249813 | A | 9/2003 |
| JP | 2003-529163 | A | 9/2003 |
| JP | 2003-288560 | A | 10/2003 |
| JP | 2003-309418 | A | 10/2003 |
| JP | 2003-317060 | A | 11/2003 |
| JP | 2003-331246 | A | 11/2003 |
| JP | 2003-332820 | A | 11/2003 |
| JP | 2003-536302 | A | 12/2003 |
| JP | 2004-040597 | A | 2/2004 |
| JP | 2004-505481 | A | 2/2004 |
| JP | 2004-082775 | A | 3/2004 |
| JP | 2004-88218 | A | 3/2004 |
| JP | 2004-93693 | A | 3/2004 |
| JP | 2004-096566 | A | 3/2004 |
| JP | 2004-127230 | A | 4/2004 |
| JP | 2004-213582 | A | 7/2004 |

(56) References Cited

FOREIGN PATENT DOCUMENTS

| | | | |
|---|---|---|---|
| JP | 2004-519916 | A | 7/2004 |
| JP | 2004-234595 | A | 8/2004 |
| JP | 2004-253858 | A | 9/2004 |
| JP | 2004-527864 | A | 9/2004 |
| JP | 2004-280390 | A | 10/2004 |
| JP | 2004-287767 | A | 10/2004 |
| JP | 2004-297249 | A | 10/2004 |
| JP | 2004-297681 | A | 10/2004 |
| JP | 2004-304370 | A | 10/2004 |
| JP | 2004-319848 | A | 11/2004 |
| JP | 2004-326380 | A | 11/2004 |
| JP | 2004-334268 | A | 11/2004 |
| JP | 2004-336250 | A | 11/2004 |
| JP | 2004-343000 | A | 12/2004 |
| JP | 2004-362190 | A | 12/2004 |
| JP | 2004-362341 | A | 12/2004 |
| JP | 2004-362602 | A | 12/2004 |
| JP | 2005-5866 | A | 1/2005 |
| JP | 2005-18156 | A | 1/2005 |
| JP | 2005-124061 | A | 5/2005 |
| JP | 2005-128592 | A | 5/2005 |
| JP | 2005-129019 | A | 5/2005 |
| JP | 2005-135132 | A | 5/2005 |
| JP | 2005-136528 | A | 5/2005 |
| JP | 2005-137032 | A | 5/2005 |
| JP | 3653099 | B2 | 5/2005 |
| JP | 2005-165839 | A | 6/2005 |
| JP | 2005-167327 | A | 6/2005 |
| JP | 2005-167813 | A | 6/2005 |
| JP | 2005-190417 | A | 7/2005 |
| JP | 2005-191705 | A | 7/2005 |
| JP | 2005-210676 | A | 8/2005 |
| JP | 2005-210680 | A | 8/2005 |
| JP | 2005-217822 | A | 8/2005 |
| JP | 2005-236339 | A | 9/2005 |
| JP | 2005-244778 | A | 9/2005 |
| JP | 2005-252853 | A | 9/2005 |
| JP | 2005-275870 | A | 10/2005 |
| JP | 2005-284352 | A | 10/2005 |
| JP | 2005-293537 | A | 10/2005 |
| JP | 2005-295135 | A | 10/2005 |
| JP | 2005-311205 | A | 11/2005 |
| JP | 2005-321305 | A | 11/2005 |
| JP | 2005-322119 | A | 11/2005 |
| JP | 2005-335755 | A | 12/2005 |
| JP | 2005-340759 | A | 12/2005 |
| JP | 2005-345802 | A | 12/2005 |
| JP | 2005-346820 | A | 12/2005 |
| JP | 2005-352858 | A | 12/2005 |
| JP | 2006-13976 | A | 1/2006 |
| JP | 2006-025390 | A | 1/2006 |
| JP | 2006-031766 | A | 2/2006 |
| JP | 2006-39902 | A | 2/2006 |
| JP | 2006-42059 | A | 2/2006 |
| JP | 2006-42097 | A | 2/2006 |
| JP | 2006-67479 | A | 3/2006 |
| JP | 2006-72706 | A | 3/2006 |
| JP | 2006-80367 | A | 3/2006 |
| JP | 2006-92630 | A | 4/2006 |
| JP | 2006-102953 | A | 4/2006 |
| JP | 2006-107296 | A | 4/2006 |
| JP | 2006-513594 | A | 4/2006 |
| JP | 2006-148518 | A | 6/2006 |
| JP | 2006-151402 | A | 6/2006 |
| JP | 2006-174151 | A | 6/2006 |
| JP | 2006-195795 | A | 7/2006 |
| JP | 2006-203187 | A | 8/2006 |
| JP | 2006-203852 | A | 8/2006 |
| JP | 2006-217000 | A | 8/2006 |
| JP | 2006-232292 | A | 9/2006 |
| JP | 2006-237674 | A | 9/2006 |
| JP | 2006-270212 | A | 10/2006 |
| JP | 2006-270766 | A | 10/2006 |
| JP | 2006-285911 | A | 10/2006 |
| JP | 2006-295879 | A | 10/2006 |
| JP | 2006-302219 | A | 11/2006 |
| JP | 2006-309401 | A | 11/2006 |
| JP | 2006-311239 | A | 11/2006 |
| JP | 2006-323481 | A | 11/2006 |
| JP | 2006-339964 | A | 12/2006 |
| JP | 2007-007888 | A | 1/2007 |
| JP | 2007-13120 | A | 1/2007 |
| JP | 2007-28002 | A | 2/2007 |
| JP | 2007-043535 | A | 2/2007 |
| JP | 2007-048126 | A | 2/2007 |
| JP | 2007-65822 | A | 3/2007 |
| JP | 2007-79687 | A | 3/2007 |
| JP | 2007-81712 | A | 3/2007 |
| JP | 2007-096768 | A | 4/2007 |
| JP | 2007-102348 | A | 4/2007 |
| JP | 2007-122542 | A | 5/2007 |
| JP | 2007-150642 | A | 6/2007 |
| JP | 2007-150868 | A | 6/2007 |
| JP | 2007-159083 | A | 6/2007 |
| JP | 2007-159129 | A | 6/2007 |
| JP | 2007-172369 | A | 7/2007 |
| JP | 2007-172527 | A | 7/2007 |
| JP | 2007-228325 | A | 9/2007 |
| JP | 2007-266999 | A | 10/2007 |
| JP | 2007-287128 | A | 11/2007 |
| JP | 2007-312350 | A | 11/2007 |
| JP | 2007-324865 | A | 12/2007 |
| JP | 2008-033716 | A | 2/2008 |
| JP | 2008-72243 | A | 3/2008 |
| JP | 4069958 | B2 | 4/2008 |
| JP | 2008-107947 | A | 5/2008 |
| JP | 2008-148345 | A | 6/2008 |
| JP | 2008-519347 | A | 6/2008 |
| JP | 2008-160874 | A | 7/2008 |
| JP | 11-175678 | A | 1/2009 |
| JP | 2009-25870 | A | 2/2009 |
| JP | 2009-27291 | A | 2/2009 |
| NL | 9100176 | A | 3/1992 |
| NL | 9100347 | A | 3/1992 |
| WO | 99/67754 | A1 | 12/1999 |
| WO | 00/10122 | A2 | 2/2000 |
| WO | 01/95242 | A2 | 12/2001 |
| WO | 02/061675 | A1 | 8/2002 |
| WO | 02/097723 | A1 | 12/2002 |
| WO | 03/079305 | A1 | 9/2003 |
| WO | 2004/036772 | A1 | 4/2004 |
| WO | 2004/070879 | A | 8/2004 |
| WO | 2004/072892 | A1 | 8/2004 |
| WO | 2005/073937 | A | 8/2005 |
| WO | 2005/091434 | A1 | 9/2005 |
| WO | 2005/115849 | A1 | 12/2005 |
| WO | 2006/045682 | A | 5/2006 |
| WO | 2006/048663 | A1 | 5/2006 |
| WO | 2006/114821 | A1 | 11/2006 |
| WO | 2007/083574 | A1 | 7/2007 |
| WO | 2007/083575 | A1 | 7/2007 |
| WO | 2007/086130 | A1 | 8/2007 |
| WO | 2007/102360 | A1 | 9/2007 |
| WO | 2007/119310 | A1 | 10/2007 |
| WO | 2007/125683 | A1 | 11/2007 |
| WO | 2007/138857 | A1 | 12/2007 |
| WO | 2008/007606 | A | 1/2008 |
| WO | 2008/136220 | A1 | 11/2008 |
| WO | 2008/140037 | A1 | 11/2008 |
| WO | 2009/011376 | A1 | 1/2009 |
| WO | 2009/081719 | A1 | 7/2009 |
| WO | 2009/110381 | A1 | 9/2009 |

OTHER PUBLICATIONS

Dokai et al.: "Wireless IC Device and Component for Wireless IC Device"; U.S. Appl. No. 12/359,690, filed Jan. 26, 2009.

Dokai et al.: "Test System for Radio Frequency IC Devices and Method of Manufacturing Radio Frequency IC Devices Using the Same", U.S. Appl. No. 12/388,826, filed Feb. 19, 2009.

Official Communication issued in International Application No. PCT/JP2008/061955, mailed on Sep. 30, 2008.

Official Communication issued in International Application No. PCT/JP2007/066721, mailed on Nov. 27, 2007.

(56) References Cited

OTHER PUBLICATIONS

Official Communication issued in International Application No. PCT/JP2007/070460, mailed on Dec. 11, 2007.
Kato et al.: "Wireless IC Device"; U.S. Appl. No. 12/390,556, filed Feb. 23, 2009.
Kato et al.: "Inductively Coupled Module and Item With Inductively Coupled Module"; U.S. Appl. No. 12/398,497, filed Mar. 5, 2009.
Official Communication issued in International Patent Application No. PCT/JP2008/050945, mailed on May 1, 2008.
Kato et al.: "Article Having Electromagnetic Coupling Module Attached Thereto"; U.S. Appl. No. 12/401,767, filed Mar. 11, 2009.
Taniguchi et al.: "Antenna Device and Radio Frequency IC Device"; U.S. Appl. No. 12/326,117, filed Dec. 2, 2008.
Official Communication issued in International Patent Application No. PCT/JP2008/061442, mailed on Jul. 22, 2008.
Kato et al.: "Container With Electromagnetic Coupling Module"; U.S. Appl. No. 12/426,369, filed Apr. 20, 2009.
Kato: "Wireless IC Device"; U.S. Appl. No. 12/429,346, filed Apr. 24, 2009.
Official communication issued in counterpart European Application No. 08 77 7758, dated on Jun. 30, 2009.
Official communication issued in counterpart Japanese Application No. 2008-103741, mailed on May 26, 2009.
Official communication issued in counterpart Japanese Application No. 2008-103742, mailed on May 26, 2009.
Official communication issued in International Application No. PCT/JP2008/050358, mailed on Mar. 25, 2008.
Official communication issued in International Application No. PCT/JP2008/050356, mailed on Mar. 25, 2008.
Osamura et al.: "Packaging Material With Electromagnetic Coupling Module,"; U.S. Appl. No. 12/536,663, filed Aug. 6, 2009.
Osamura et al.: "Packaging Material With Electromagnetic Coupling Module," U.S. Appl. No. 12/536,669, filed Aug. 6, 2009.
Dokai et al.: "Wireless IC Device and Component for Wireless IC Device,"; U.S. Appl. No. 12/543,553, filed Aug. 19, 2009.
Shioya et al.: "Wireless IC Device,"; U.S. Appl. No. 12/551,037, filed Aug. 31, 2009.
Ikemoto: "Wireless IC Device and Manufacturing Method Thereof,"; U.S. Appl. No. 12/579,672, filed Oct. 15, 2009.
Official communication issued in International Application No. PCT/JP2008/058614, mailed on Jun. 10, 2008.
Official communication issued in counterpart International Application No. PCT/JP2008/071502, mailed Feb. 24, 2009.
Kato et al.: "Wireless IC Device and Manufacturing Method Thereof,"; U.S. Appl. No. 12/432,854, filed Apr. 30, 2009.
Official communication issued in counterpart International Application No. PCT/JP2008/058168, mailed Aug. 12, 2008.
Official communication issued in counterpart International Application No. PCT/JP2008/062886, mailed Oct. 21, 2008.
Kato et al.: "Wireless IC Device,"; U.S. Appl. No. 12/469,896, filed May 21, 2009.
Ikemoto et al.: "Wireless IC Device,"; U.S. Appl. No. 12/496,709, filed Jul. 2, 2009.
Official communication issued in counterpart International Application No. PCT/JP2008/062947, mailed Aug. 19, 2008.
Official communication issued in counterpart International Application No. PCT/JP2008/056026, mailed Jul. 1, 2008.
Ikemoto et al.: "Wireless IC Device and Electronic Apparatus,"; U.S. Appl. No. 12/503,188, filed Jul. 15, 2009.
Official communication issued in counterpart International Application No. PCT/JP2008/055567, mailed May 20, 2008.
Official communication issued in counterpart International Application No. PCT/JP2008/051853, mailed Apr. 22, 2008.
Official communication issued in counterpart International Application No. PCT/JP2008/057239, mailed Jul. 22, 2008.
Kimura et al.: "Wireless IC Device,"; U.S. Appl. No. 12/510,338, filed Jul. 28, 2009.
Kato et al.: "Wireless IC Device,"; U.S. Appl. No. 12/510,340, filed Jul. 28, 2009.
Kato: "Wireless IC Device,"; U.S. Appl. No. 12/510,344, filed Jul. 28, 2009.
Kato et al.: "Wireless IC Device,"; U.S. Appl. No. 12/510,347, filed Jul. 28, 2009.
Official Communication issued in International Patent Application No. PCT/JP2009/056934, mailed on Jun. 30, 2009.
Kato et al.: "Wireless IC Device"; U.S. Appl. No. 12/903,242, filed Oct. 13, 2010.
Kato et al.: "Wireless IC Device"; U.S. Appl. No. 12/940,103, filed Nov. 5, 2010.
Kato et al.: "Wireless IC Device System and Method of Determining Authenticity of Wireless IC Device"; U.S. Appl. No. 12/940,105, filed Nov. 5, 2010.
Official Communication issued in International Patent Application No. PCT/JP2009/059669, mailed on Aug. 25, 2009.
Official Communication issued in International Patent Application No. PCT/JP2009/062181, mailed on Oct. 13, 2009.
Official Communication issued in corresponding Japanese Application No. 2010-501323, mailed on Apr. 6, 2010.
Kato et al.: "Component of Wireless IC Device and Wireless IC Device"; U.S. Appl. No. 12/944,099, filed Nov. 11, 2010.
Kato et al.: Wireless IC Device and Manufacturing Method Thereof; U.S. Appl. No. 12/961,599, filed Dec. 7, 2010.
Kataya et al.: "Radio Frequency IC Device and Electronic Apparatus"; U.S. Appl. No. 12/959,454, filed Dec. 3, 2010.
Ikemoto et al.: "Radio IC Device"; U.S. Appl. No. 12/981,582, filed Dec. 30, 2010.
Official Communication issued in International Patent Application No. PCT/JP2009/062801, mailed on Oct. 27,2009.
Ikemoto et al.: "Wireless IC Device and Electronic Apparatus"; U.S. Appl. No. 13/022,695, filed Feb. 8, 2011.
Official Communication issued in International Patent Application No. PCT/JP2009/067778, mailed on Jan. 26, 2010.
Kato: "Wireless IC Device and Method for Manufacturing Same"; U.S. Appl. No. 13/022,693, filed Feb. 8, 2011.
Kato: "Radio IC Device"; U.S. Appl. No. 13/080,775, filed Apr. 6, 2011.
Official Communication issued in International Patent Application No. PCT/JP2009/067140, mailed on Dec. 22, 2009.
Official Communication issued in International Patent Application No. PCT/JP2008/063025, mailed on Aug. 12, 2008.
Kato et al.: "Wireless IC Device,"; U.S. Appl. No. 12/603,608, filed Oct. 22, 2009.
Kato et al.: "Wireless IC Device,"; U.S. Appl. No. 12/688,072, filed Jan. 15, 2010.
Official Communication issued in International Patent Application No. PCT/JP2009/053693, mailed on Jun. 9, 2009.
Kato: "Composite Antenna,"; U.S. Appl. No. 12/845,846, filed Jul. 29, 2010.
Official Communication issued in International Patent Application No. PCT/JP2009/053690, mailed on Jun. 2, 2009.
Kato et al.: "Radio Frequency IC Device and Radio Communication System,"; U.S. Appl. No. 12/859,340, filed Aug. 19, 2010.
Official Communication issued in International Patent Application No. PCT/JP2009/055758, mailed on Jun. 23, 2009.
Kato et al.: "Wireless IC Device,"; U.S. Appl. No. 12/859,880, filed Aug. 20, 2010.
Official Communication issued in International Patent Application No. PCT/JP2009/057482, mailed on Jul. 21, 2009.
Kataya et al.: "Wireless IC Device, Electronic Apparatus, and Method for Adjusting Resonant Frequency of Wireless IC Device,"; U.S. Appl. No. 12/861,945, filed Aug. 24, 2010.
Kato: "Wireless IC Device and Electromagnetic Coupling Module,"; U.S. Appl. No. 12/890,895, filed Sep. 27, 2010.
Official Communication issued in International Patent Application No. PCT/JP2009/059410, mailed on Aug. 4, 2009.
Kato et al.: "Wireless IC Device"; U.S. Appl. No. 12/902,174, filed Oct. 12, 2010.
Official Communication issued in International Patent Application No. PCT/JP2009/059259, mailed on Aug. 11, 2009.
Official Communication issued in corresponding Japanese Patent Application No. 2010-506742, mailed on Apr. 6, 2010.

(56) References Cited

OTHER PUBLICATIONS

Official Communication issued in International Patent Application No. PCT/JP2009/056698, mailed on Jul. 7, 2009.
Official communication issued in Japanese Application No. 2007-531524, mailed on Sep. 11, 2007.
Official communication issued in Japanese Application No. 2007-531525, mailed on Sep. 25, 2007.
Official communication issued in Japanese Application No. 2007-531524, mailed on Dec. 12, 2007.
Official communication issued in European Application No. 07706650.4, mailed on Nov. 24, 2008.
Mukku-Sha, "Musen IC Tagu Katsuyo-no Subete⇆ "(All About Wireless IC Tags"), RFID, pp. 112-126.
Dokai et al.: "Wireless IC Device and Component for Wireless IC Device"; U.S. Appl. No. 11/624,382, filed Jan. 18, 2007.
Dokai et al.: "Wireless IC Device, and Component for Wireless IC Device"; U.S. Appl. No. 11/930,818, filed Oct. 31, 2007.
Kato et al.: "Wireless IC Device"; U.S. Appl. No. 12/042,399, filed Mar. 5, 2008.
Official communication issued in related U.S. Appl. No. 12/042,399; mailed on Aug. 25, 2008.
English translation of NL9100176, published on Mar. 2, 1992.
English translation of NL9100347, published on Mar. 2, 1992.
Kato et al.: "Antenna"; U.S. Appl. No. 11/928,502, filed Oct. 30, 2007.
Kato et al.: "Wireless IC Device"; U.S. Appl. No. 12/211,117, filed Sep. 16, 2008.
Kato et al: "Antenna"; U.S. Appl. No. 11/688,290, filed Mar. 20, 2007.
Kato et al.: "Electromagnetic-Coupling-Module-Attached Article"; U.S. Appl. No. 11/740,509, filed Apr. 26, 2007.
Kato et al.: "Product Including Power Supply Circuit Board"; U.S. Appl. No. 12/234,949, filed Sep. 22, 2008.
Kato et al.: "Data Coupler"; U.S. Appl. No. 12/252,475, filed Oct. 16, 2008.
Kato et al.; "Information Terminal Device"; U.S. Appl. No. 12/267,666, filed Nov. 10, 2008.
Kato et al.: "Wireless IC Device and Wireless IC Device Composite Component"; U.S. Appl. No. 12/276,444, filed Nov. 24, 2008.
Dokai et al.: "Optical Disc"; U.S. Appl. No. 12/326,916, filed Dec. 3, 2008.
Dokai et al.: "System for Inspecting Electromagnetic Coupling Modules and Radio IC Devices and Method for Manufacturing Electromagnetic Coupling Modules and Radio IC Devices Using the System"; U.S. Appl. No. 12/274,400, filed Nov. 20, 2008.
Kato: "Wireless IC Device"; U.S. Appl. No. 11/964,185, filed Dec. 26, 2007.
Kato et al.: "Radio Frequency IC Device"; U.S. Appl. No. 12/336,629, filed Dec. 17, 2008.
Kato et al.: "Wireless IC Device and Component for Wireless IC Device"; U.S. Appl. No. 12/339,198, filed Dec. 19, 2008.
Ikemoto et al.: "Wireless IC Device"; U.S. Appl. No. 11/851,651, filed Sep. 7, 2007.
Kataya et al.: "Wireless IC Device and Electronic Device"; U.S. Appl. No. 11/851,661, filed Sep. 7, 2007.
Dokai et al.: "Antenna and Radio IC Device"; U.S. Appl. No. 12/350,307, filed Jan. 8, 2009.
Official Communication issued in corresponding Japanese Patent Application No. 2010-534764, mailed on Mar. 26, 2013.

* cited by examiner

WIRELESS IC DEVICE

BACKGROUND OF THE INVENTION

1. Field of the Invention

The present invention relates to wireless integrated circuit (IC) devices including a wireless IC and a radiation plate. More particularly, the present invention relates to a wireless IC device preferably for use in a radio frequency identification (RFID) system performing communication using an HF band frequency.

2. Description of the Related Art

In recent years, an RFID system has been developed as an article management system in which electromagnetic-field-based contactless communication is performed between a reader/writer generating an induction field and a wireless IC tag (hereinafter, also referred to as a wireless IC device) affixed to an article and storing predetermined information so that the predetermined information is transmitted.

The wireless IC tag used in this RFID system includes a wireless IC chip that processes a predetermined radio signal and a radiation plate that transmits and receives the radio signal. For example, a wireless IC tag disclosed in Japanese Unexamined Patent Application Publication No. 2007-102348 is known.

The wireless IC tag disclosed in Japanese Unexamined Patent Application Publication No. 2007-102348 is constituted by a multilayer antenna pattern and an IC chip. Swirling electrodes are disposed on a plurality of layers to form the antenna pattern. A resonance circuit is constituted by inductance generated by the electrodes and inter-electrode capacitance and capacitance of the IC chip. The resonant frequency of this resonance circuit is set equal to communication frequency, e.g., 13.56 MHz. The wireless IC tag communicates with a reader/writer through the antenna pattern.

However, the wireless IC tag has the following problems. Since the antenna pattern is covered with a protection film but is exposed to the outside, a magnetic field generated by the antenna pattern leaks to the outside and an inductance value of the antenna pattern changes because of influences of the dielectric constant and the shape of articles attached with the tag. Variance of the resonant frequency due to the inductance value change causes a communication failure.

To prevent the magnetic field from leaking to the outside and to increase the inductance value, the antenna pattern may be disposed in a magnetic body, such as ferrite. However, when the antenna pattern is disposed completely within the magnetic body, the magnetic field is trapped inside the magnetic body and communication cannot be performed.

SUMMARY OF THE INVENTION

Preferred embodiments of the present invention provide a wireless IC device having a resonant frequency that is hardly altered or affected by external influences and that reliably communicates with a reader/writer.

A wireless IC device according to a preferred embodiment of the present invention includes a wireless IC arranged to process a radio signal; a feeder circuit board including a magnetic material and coupled to the wireless IC, the feeder circuit board including a feeder circuit that includes an inductance element; and a radiation electrode arranged on at least one principal surface of the feeder circuit board to be electromagnetically coupled to the feeder circuit and including at least two adjacent open ends.

The wireless IC is preferably coupled to the radiation electrode through the feeder circuit in the wireless IC device, so that wireless communication with a reader/writer is performed using an HF band frequency. Since the feeder circuit is disposed in the feeder circuit board including a magnetic material, an inductance value is increased and a resonant frequency is hardly altered or affected by external influences. A magnetic field is trapped when the feeder circuit is arranged in a magnetic body. However, since the feeder circuit is electromagnetically coupled to the radiation electrode disposed on at least one principal surface of the feeder circuit board, current at the resonant frequency of the feeder circuit flows through the radiation electrode having at least two adjacent open ends and wireless communication at the resonant frequency of the feeder circuit can be performed through the radiation electrode.

In accordance with a wireless IC device according to a preferred embodiment of the present invention, since a feeder circuit is disposed in a magnetic body, an inductance value is increased and the resonant frequency is hardly altered or affected by external influences. As a result, the wireless IC device reliably communicates with a reader/writer through a radiation electrode.

The above and other elements, features, steps, characteristics and advantages of the present invention will become more apparent from the following detailed description of the preferred embodiments with reference to the attached drawings.

Figure 4A:
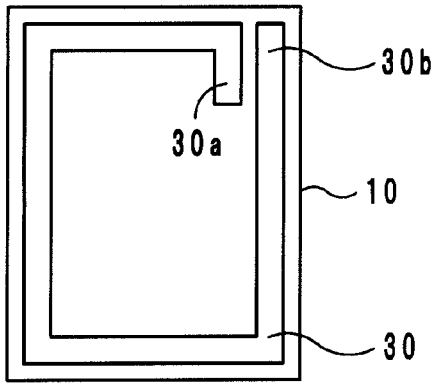
Figure 4B:
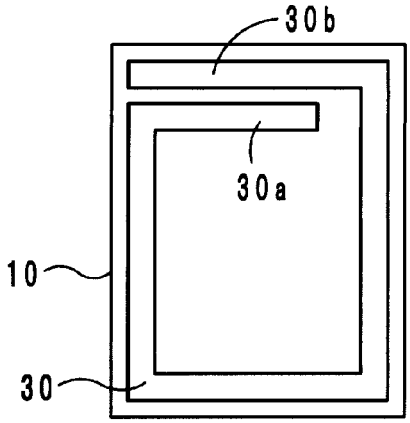
Figure 4C:
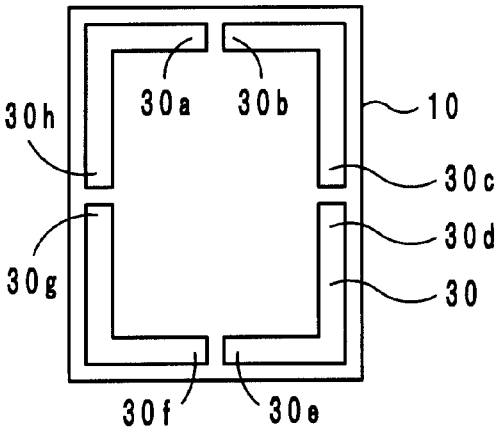

Each of FIGS. 4A, 4B, and 4C is a bottom view of a feeder circuit board illustrating an alteration of a radiation electrode.

Figure 5A:
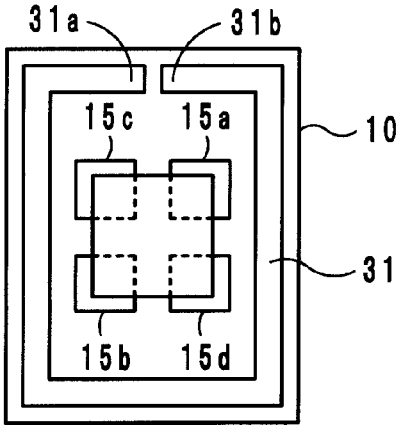
Figure 5B:
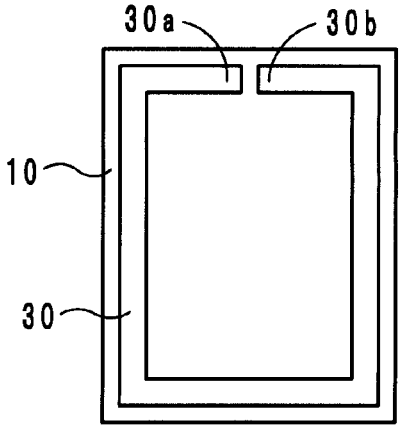

FIGS. 5A and 5B are a top view and a bottom view, respectively illustrating a wireless IC device according to a second preferred embodiment of the present invention.

Figure 6:
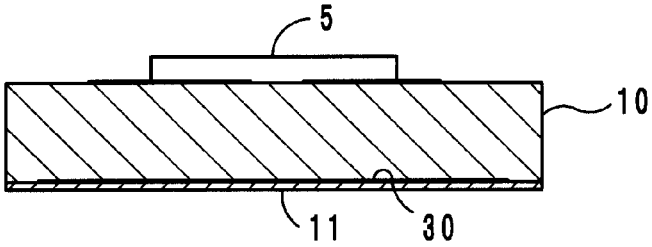

FIG. 6 is a sectional view illustrating a wireless IC device according to a third preferred embodiment of the present invention.

Figure 7:
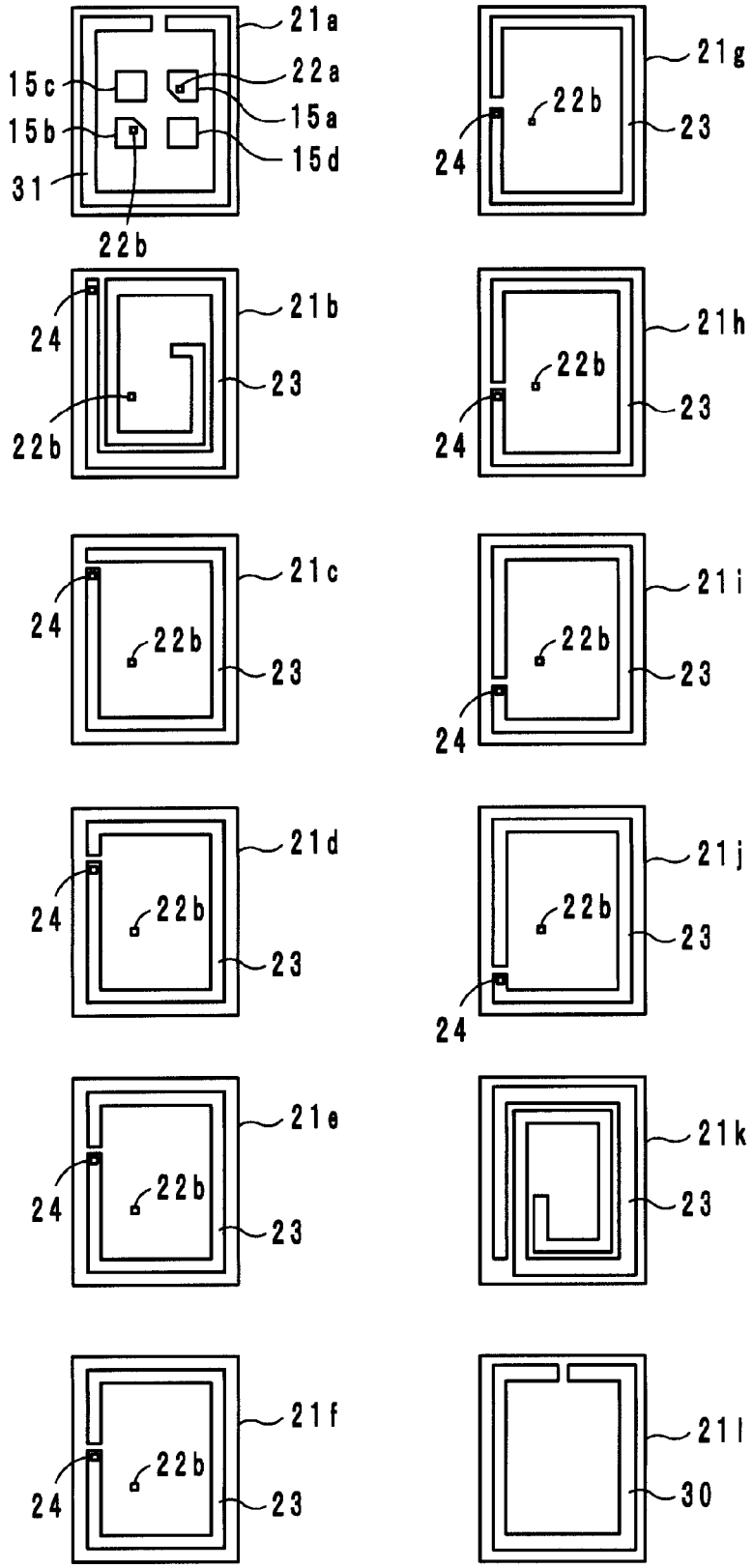

FIG. 7 is an exploded plan view of a feeder circuit board.

Figure 8:
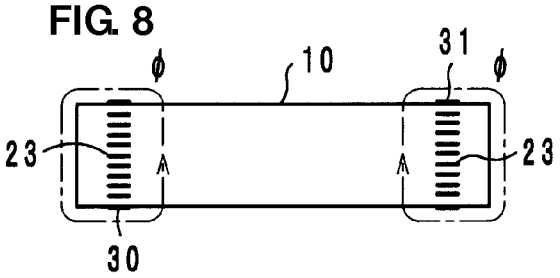

FIG. 8 is an explanatory diagram illustrating a magnetic field generated around an inductance element.

Figure 9:
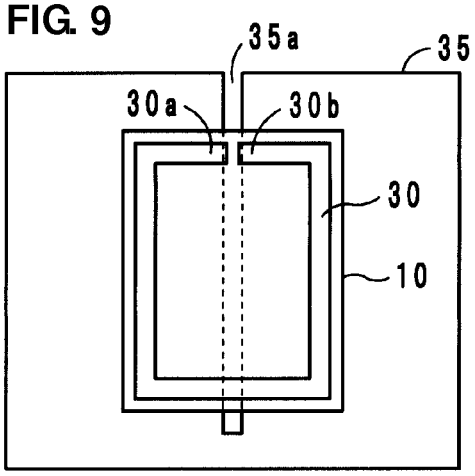

FIG. 9 is an explanatory diagram illustrating a wireless IC device according to a fourth preferred embodiment of the present invention.

Figure 10:
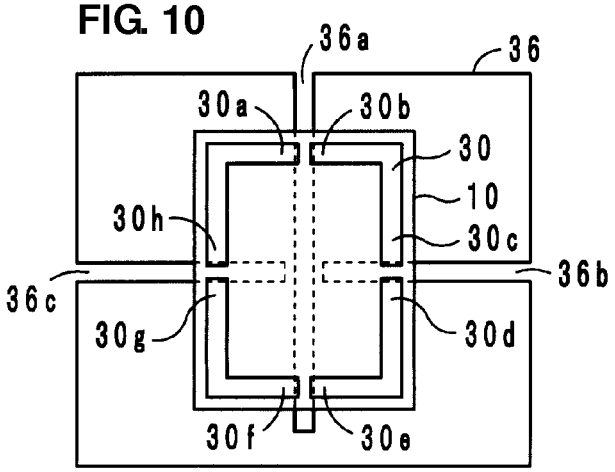

FIG. 10 is an explanatory diagram illustrating a wireless IC device according to a fifth preferred embodiment of the present invention.

DETAILED DESCRIPTION OF THE PREFERRED EMBODIMENTS

Preferred embodiments of wireless IC devices according to the present invention will be described below with reference to the accompanying drawings. In each drawing, the same reference numerals are used to refer to common components and elements to avoid redundant description.

First Preferred Embodiment

Figure 1:
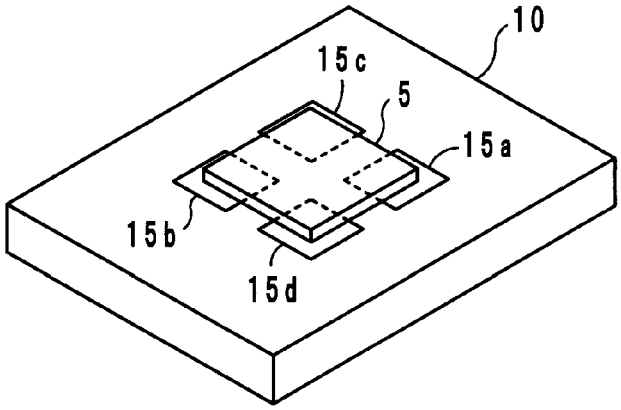
FIG. 1 is a perspective view illustrating a wireless IC device according to a first preferred embodiment of the present invention.

As illustrated in FIG. 1, a wireless IC device according to a first preferred embodiment of the present invention includes a wireless IC chip 5 configured to process a radio signal, a feeder circuit board 10, and a radiation electrode 30. The feeder circuit board 10 includes a feeder circuit 20 (a detail thereof will be described later with reference to FIG. 7) that is coupled to the wireless IC chip 5 and includes an inductance element L. The radiation electrode 30 is disposed on a lower surface of the feeder circuit board 10 to be electromagnetically coupled to the feeder circuit 20 and has two adjacent open ends 30*a* and 30*b*.

The wireless IC chip 5 includes circuits, such as a clock circuit, a logic circuit, and a memory circuit, for example, and stores necessary information. A pair of input/output terminal electrodes and a pair of mounting terminal electrodes (not shown) are preferably disposed on a lower surface of the wireless IC chip 5. The pair of input/output terminal electrodes and the pair of mounting terminal electrodes are electrically connected to feeder terminal electrodes 15*a* and 15*b* and mounting electrodes 15*c* and 15*d* on the feeder circuit board 10 through soldering or the like, respectively. The feeder terminal electrodes 15*a* and 15*b* are electrically connected to the feeder circuit 20 included in the feeder circuit board 10.

Figure 3:
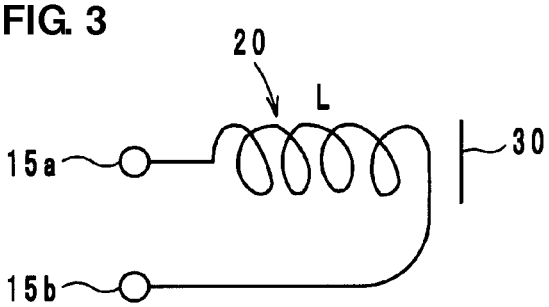
FIG. 3 is an equivalent circuit diagram of a feeder circuit.

The feeder circuit board 10 is preferably made of materials including a magnetic material, such as ferrite, for example. The feeder circuit 20 is included in a magnetic body. As illustrated by an equivalent circuit in FIG. 3, the feeder circuit 20 includes the inductance element L. One end of the inductance element L is connected to the feeder terminal electrode 15*a*, whereas the other end thereof is connected to the feeder terminal electrode 15*b*.

Figure 2A:
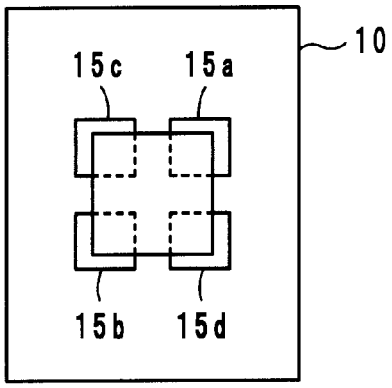
FIGS. 2A and 2B are a top view and a bottom view, respectively illustrating the wireless IC device according to the first preferred embodiment of the present invention.
Figure 2B:
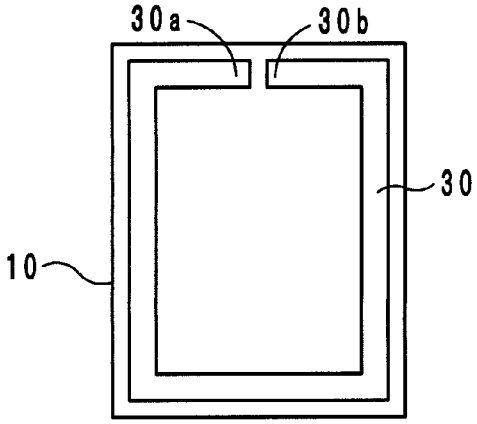

As illustrated in FIG. 2B, the radiation electrode 30 is disposed on the lower surface of the feeder circuit board 10 as a cutout loop electrode having the open ends 30*a* and 30*b*. This radiation electrode 30 is arranged to overlap the feeder circuit 20 (a loop electrode 23) provided in the feeder circuit board 10 in plan view (see FIG. 8). The radiation electrode 30 and the feeder circuit 20 are electromagnetically coupled.

In the wireless IC device of the first preferred embodiment having the above configuration, the feeder circuit 20 has a predetermined resonant frequency (e.g., around 13.56 MHz) in the HF band owing to inductance of the inductance element L and inter-electrode capacitance thereof. The wireless IC chip 5 is coupled to the radiation electrode 30 through the feeder circuit 20, so that wireless communication is performed with a reader/writer.

Since the feeder circuit 20, which is disposed in the feeder circuit board 10 including a magnetic material, has a large inductance value, the board 10 can be downsized and the resonant frequency is hardly altered or affected by external influences. A relative dielectric constant of the feeder circuit board 10 is, for example, 70 with respect to a relative dielectric constant of air equal to 1. Accordingly, when the feeder circuit 20 is arranged in the magnetic body, a magnetic field is trapped therein. However, since the feeder circuit 20 is electromagnetically coupled to the radiation electrode 30 disposed on a lower surface of the feeder circuit board 10, round current at the resonant frequency of the feeder circuit 20 flows through the radiation electrode 30 including the two adjacent open ends 30*a* and 30*b* and generates a magnetic field around the radiation electrode 30. This magnetic field allows wireless communication at the resonant frequency of the feeder circuit 20 to be performed.

That is, since the feeder circuit 20 is disposed in the magnetic body, the resonant frequency is hardly altered by external influences. Additionally, communication can be performed for sure with a reader/writer through the radiation electrode 30 that is arranged on a surface of the magnetic body to be electromagnetically coupled to the feeder circuit 20.

In addition, since the feeder circuit 20 is not directly electrically connected to the radiation electrode 30 but is electromagnetically coupled thereto, static electrical charge (low frequency noise) is not applied to the wireless IC chip 5 from the radiation electrode 30 and the wireless IC chip 5 is protected from the static electrical charge.

Meanwhile, in order to generate the magnetic field from the radiation electrode 30, the resonant frequency of the radiation electrode 30 is preferably higher than that of the feeder circuit 20. The resonant frequency of the radiation electrode 30 is determined mainly by relative dielectric constant and relative magnetic permeability of the feeder circuit board 10, length of the radiation electrode 30, and interelectrode stray capacitance involving the shape of the radiation electrode 30. Additionally, the wireless IC chip 5 is preferably arranged inside the radiation electrode 30. Since the magnetic field at a central portion of the loop radiation electrode 30 is weak, the wireless IC chip 5 (particularly, the terminal electrodes 15*a*-15*d*) is prevented from disturbing the radiation of the magnetic field.

The radiation electrode 30 may have various shapes as long as at least one electrode having at least two open ends is bent. As illustrated in FIG. 2B, the radiation electrode 30 may have a substantially C-shape or the open ends 30*a* and 30*b* may overlap as illustrated in FIGS. 4A and 4B. Alternatively, as illustrated in FIG. 4C, the radiation electrode may be divided into four portions and include open ends 30*a*-30*h*. Additionally, the radiation electrode 30 may include four linear portions.

Second Preferred Embodiment

As illustrated in FIG. 5, a wireless IC device according to a second preferred embodiment includes another radiation electrode 31 (including open ends 31*a* and 31*b*) disposed on an upper surface of a feeder circuit board 10 in addition to a radiation electrode 30 disposed on a lower surface of the feeder circuit board 10. Disposing the radiation electrodes 30 and 31 on the lower and upper surfaces of the board 10, respectively, increases radiant quantities of a magnetic field and improves gain.

Third Preferred Embodiment 3

As illustrated in FIG. 6, in a wireless IC device according to a third preferred embodiment 3, a radiation electrode 30 disposed on a lower surface of a feeder circuit board 10 preferably made of a magnetic material is covered with a non-magnetic material layer 11. The radiation electrode 31 disposed on the upper surface of the feeder circuit board 10 illustrated in FIG. 5A may be covered with a non-magnetic material layer, such as a sealing resin, for example. Covering the radiation electrode 30 with the non-magnetic material layer prevents the radiation electrode 30 from oxidizing and corroding and improves reliability.

A configuration of the feeder circuit board 10, in particular, a specific example of the included feeder circuit 20 (the inductance element L), will be described next with reference to FIG. 7. The description will be given on this feeder circuit board 10 with an assumption that the radiation electrodes 30 and 31 are disposed on the lower and upper surfaces of the board 10 illustrated in FIG. 5.

Magnetic body (ferrite) sheets 21*a*-21*k* are laminated from the upper surface of the feeder circuit board 10, whereas a non-magnetic body (e.g., ferrite having a relative magnetic permeability equal to 1) sheet 21*l* is laminated on the lower surface thereof. The terminal electrodes 15*a*-15*d*, via hole conductors 22*a* and 22*b*, and the radiation electrode 31 are formed on the sheet 21*a* of the first layer. A loop electrode 23 and via hole conductors 22*b* and 24 are formed on the sheets 21*b*-21*j* of the second-tenth layers. The loop electrode 23 is formed on the sheet 21*k* of the eleventh layer. The radiation electrode 30 is formed on the sheet 21*l* of the twelfth layer (i.e., a bottom layer).

The sheets 21*a*-21*l* are laminated, whereby the loop electrode 23 is helically connected through the via hole conductor 24 to constitute the inductance element L. One end of this inductance element L is connected to the terminal electrode 15*a* through the via hole conductor 22*a*, whereas the other end thereof is connected to the terminal electrode 15*b* through the via hole conductor 22*b*.

A magnetic field ϕ illustrated in FIG. 8, which is a sectional view of the feeder circuit board 10, is generated around the inductance element L having the above configuration. When the radiation electrodes 30 and 31 are arranged at positions where this magnetic field is strong, electromagnetic coupling between the radiation electrodes and the feeder circuit 20 gets stronger. More specifically, the radiation electrodes 30 and 31 are preferably arranged to overlap the feeder circuit 20 (the loop electrode 23) in plan view. Additionally, when the radiation electrodes are arranged at marginal portions of the upper and lower surfaces of the board 10, a radio wave is more easily radiated into the air.

Fourth and Fifth Preferred Embodiments

Wireless IC devices according to the fourth and fifth preferred embodiments include radiation plates 35 and 36, respectively, in addition to the radiation electrodes 30 and 31.

A wireless IC device illustrated in FIG. 9 includes the radiation plate 35 for the radiation electrode 30 disposed on the feeder circuit board 10 illustrated in FIG. 2. A recess portion 35*a* for the open ends 30*a* and 30*b* of the radiation electrode 30 is formed in the radiation plate 35. A magnetic field is radiated from the recess portion 35*a*.

A wireless IC device illustrated in FIG. 10 includes the radiation plate 36 for the radiation electrode 30 disposed on the feeder circuit board 10 illustrated in FIG. 4C. Recess portions 36*a*, 36*b*, and 36*c* for the open ends 30*a*-30*h* of the radiation electrode 30 are formed in the radiation plate 36. A magnetic field is radiated from the recess portions 36*a*, 36*b*, and 36*c*.

Other Preferred Embodiments

The wireless IC devices according to the present invention are not limited to the foregoing preferred embodiments and can be variously modified within a scope of the spirit thereof.

In particular, in addition to mounting the wireless IC chip 5 on the feeder circuit board 10, a wireless IC may be included in the feeder circuit board 10. Additionally, the wireless IC may be integrated into the feeder circuit 20 using a process that is the same as that of the feeder circuit 20, for example.

As described above, various preferred embodiments of the present invention are useful for wireless IC devices and are particularly advantageous in that resonant frequency is hardly altered or affected by external influences and reliably communicates with a reader/writer can be performed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A wireless IC device, comprising:

a wireless IC arranged to process a radio signal;

a feeder circuit board including a feeder circuit that includes an inductance element; and a loop electrode including at least two adjacent open ends; wherein the feeder circuit board includes a magnetic body that includes a magnetic material;

the inductance element is disposed in the magnetic body;

the loop electrode is disposed directly on an outer exposed surface of the magnetic body of the feeder circuit board;

the loop electrode is electromagnetically coupled to the inductance element via the magnetic body such that the inductance element is connected or coupled between the wireless IC and the loop electrode and the wireless IC is connected to the loop electrode via the feeder circuit; and the radio signal processed by the wireless IC is transmitted from the wireless IC to the inductance element, from the inductance element to the loop electrode, and then radiated from the loop electrode.

2. The wireless IC device according to claim 1, wherein the loop electrode is arranged on two opposing principal surfaces of the feeder circuit board.

3. The wireless IC device according to claim 1, wherein the loop electrode is a cutout loop electrode including the open ends.

4. The wireless IC device according to claim 1, wherein the loop electrode is arranged to overlap the feeder circuit provided in the feeder circuit board in plan view.

5. The wireless IC device according to claim 1, wherein the loop electrode is arranged at a marginal portion of the principal surface of the feeder circuit board.

6. The wireless IC device according to claim 1, wherein the loop electrode is covered with a non-magnetic material layer.

7. The wireless IC device according to claim 1, wherein resonant frequency of the loop electrode is higher than resonant frequency of the feeder circuit.

8. The wireless IC device according to claim 1, wherein the wireless IC is arranged inside the loop electrode.

9. The wireless IC device according to claim 1, further comprising a radiation plate electromagnetically coupled to the loop electrode.

10. The wireless IC device according to claim 1, wherein:

a central axis of the loop electrode coincides or substantially coincides with a central axis of the inductance element; and outer dimensions of the loop electrode are equal or substantially equal to outer dimensions of the inductance element.

* * * * *